US005693918A

United States Patent [19]

Bremigan et al.

[11] Patent Number: 5,693,918

[45] Date of Patent: Dec. 2, 1997

[54] ACTIVE EXHAUST SILENCER

[75] Inventors: Cary D. Bremigan; C. Raymond Cheng, both of Madison, Wis.

[73] Assignee: Digisonix, Inc., Middleton, Wis.

[21] Appl. No.: 681,733

[22] Filed: Jul. 29, 1996

Related U.S. Application Data

[63] Continuation-in-part of Ser. No. 301,124, Sep. 6, 1994, Pat. No. 5,541,373.

[51] Int. Cl.[6] ..... F01N 1/06

[52] U.S. Cl. ..... 181/206; 381/71

[58] Field of Search ..... 181/206; 381/71

[56] References Cited

U.S. PATENT DOCUMENTS

| | | | |
|---|---|---|---|
| 3,826,870 | 7/1974 | Wurm et al. . | |
| 4,359,136 | 11/1982 | Eriksson | 181/269 |
| 4,665,549 | 5/1987 | Eriksson et al. | 381/71 |
| 4,805,733 | 2/1989 | Kato et al. | 181/206 |
| 5,025,889 | 6/1991 | Lockwood et al. | 181/250 |
| 5,044,464 | 9/1991 | Bremigan | 181/206 |
| 5,060,271 | 10/1991 | Geddes | 381/71 |
| 5,063,598 | 11/1991 | Geddes | 381/71 |
| 5,088,575 | 2/1992 | Eriksson | 181/206 |
| 5,097,923 | 3/1992 | Ziegler et al. | 181/206 |
| 5,119,902 | 6/1992 | Geddes | 181/206 |
| 5,272,286 | 12/1993 | Cain et al. | 181/206 |
| 5,336,856 | 8/1994 | Krider et al. | 181/206 |
| 5,418,873 | 5/1995 | Eriksson | 381/71 |

FOREIGN PATENT DOCUMENTS 1357330 6/1974 United Kingdom .

*Primary Examiner*—Khanh Dang
*Attorney, Agent, or Firm*—Andrus, Sceales, Starke & Sawall

[57] ABSTRACT

An active silencer for a vehicle exhaust system that is constructed so that it can be hung underneath the vehicle without altering the vehicle. The silencer has a chamber isolated from the exhaust flow. A duct spans longitudinally through the chamber. One or more loudspeakers (e.g. 2 or 4 loudspeakers) are mounted on the duct side-by-side. The loudspeakers share a common tuning volume within the duct which is ported to a mixing apparatus where the canceling acoustic wave mixes with noise from the exhaust flow before the exhaust noise exits to the atmosphere.

4 Claims, 4 Drawing Sheets

ACTIVE EXHAUST SILENCER

This application is a continuation-in-part of U.S. Pat. No. 5,541,373, application Ser. No. 08/301,124, filed on Sep. 6, 1994.

FIELD OF THE INVENTION

The invention relates to active silencing systems, and in particular, to an active silencer for vehicle exhaust systems.

BACKGROUND OF THE INVENTION

Using an active silencer in a vehicle exhaust system can improve engine efficiency because of reduced exhaust back pressure. One problem with active silencers is that active silencers are often bulky and their use requires the vehicle to be specifically designed or retro fitted to accommodate the active silencer. The invention is an active silencer and a method of making the same that allows for compact, low-profile construction, thus substantially eliminating this problem.

In general, active silencers inject a canceling acoustic wave to destructively interfere with and cancel an input acoustic wave. It is typical to sense the input acoustic wave with an input microphone and the output acoustic wave with an error microphone. The input microphone supplies an input or feedforward signal to an electronic controller, and the error microphone supplies an error or feedback signal to the electronic controller. The electronic controller, in turn, supplies a correction signal to one or more loudspeakers that generate a canceling acoustic wave to destructively interfere with an input acoustic wave such that the output acoustic wave at the error microphone is zero (or at least reduced).

In a vehicle exhaust system, it is desirable to keep the speakers in an active silencer protected from the hot exhaust gases to prevent premature deterioration. One way of providing such isolation is disclosed by Bremigan in U.S. Pat. No. 5,044,464 in which two speakers are located in a chamber away from the main exhaust flow. The canceling acoustic waves are directed from the chamber to the exhaust flow. In U.S. Pat. Nos. 5,233,137 and 5,229,556, Geddes discloses a system isolating the speakers from the exhaust flow wherein a tuned chamber is ported to the exhaust flow. This system has the advantage of improving speaker efficiency over the frequency band width appropriate for the application.

In an exhaust system, it is also desirable that the active silencer does not significantly shake or vibrate during operation. Such shaking or vibration can be to a large extent due to movement of the speakers. The Bremigan and Geddes patents show a pair of speakers mounted face-to-face so the axial load of the speakers cancel one another thus eliminating structure vibrations by the speakers. However, the face-to-face speaker arrangement adds considerable bulk to the design. In particular, the dimensions of a system using a face-to-face arrangement is too tall to fit in a conventional automobile without retrofitting.

Therefore, it is desirable to have a low-profile active exhaust silencer in which the speakers are isolated from the exhaust flow. It is also desirable to provide an active exhaust silencer that is otherwise convenient to package on the vehicle.

SUMMARY OF THE INVENTION

The invention is an active silencer that can have a low-profile for canceling noise from an exhaust pipe, and a method of making the same. The active silencer has a chamber containing one or more canceling loudspeakers that are isolated from the exhaust flow. The chamber preferably has a low-profile (i.e. an aspect ratio of less than one meaning that the height of the chamber is less than the width of the chamber). Such a low-profile chamber can be hung from a conventional automobile in the same manner as a conventional passive muffler.

In the preferred embodiment of the invention disclosed in the parent application, the silencer chamber is defined by an outer wall, and a front end wall and a rear end wall. A partition separates the chamber into a top volume and a bottom volume. The partition spans from the front end wall to the rear end wall and has a front and a rear speaker hole. Two loudspeakers are mounted side-by-side to the partition through the speaker holes. The speaker diaphragms point downward and are in acoustic communication with the bottom volume in the chamber. The bottom volume of the chamber is preferably a tuning chamber shared by both speakers. A port from the bottom volume through the front end wall provides a path for the canceling acoustic wave to the exhaust flow. The exhaust flow and the canceling acoustic wave can be mixed in a mixing chamber that has an end open to the atmosphere. An error microphone can be located in the mixing chamber.

It is preferred that the outer wall be an oval-shaped cylindrical wall and that the front and the rear end walls be oval-shaped, and substantially flat and perpendicular to the outer wall. Reinforcement flanges should be used to reinforce the outer cylindrical wall and also to reinforce the partition. The partition can also be reinforced by bending the peripheral edges of the partition before attaching the partition to the outer and end walls. This construction provides strength which allows the speakers to be mounted side-by-side facing the same downward direction, thus reducing the height of the chamber.

Also, the partition can be positioned low in the chamber so that the top volume (i.e. the speaker back volume) is larger than the bottom volume (i.e. the tuning chamber). In addition, when mounting the speakers to the partition, spacers can be used to position the speakers lower in the chamber. These two features also help reduce the height of the chamber.

Another aspect of the invention disclosed in the parent application relates to a method for making an active silencer as described above. The method provides an efficient means for making an active silencer. The method is possible in part because the complexity of the silencer is minimized by mounting one or more speakers side-by-side to share a common top and bottom volume.

It can thus be appreciated that the invention allows for a low-profile construction of an active silencer, while at the same time keeps the speakers isolated from the exhaust flow.

In an alternative embodiment of the invention disclosed in FIGS. 6–9 of the present application, the interior of the silencer chamber is separated into a first and a second volume by a duct spanning longitudinally through the chamber. The duct preferably spans from the rear end wall of the chamber, through the chamber, and through the front end wall of the chamber. The duct preferably has a rectangular cross-section. It is preferred that a pair of speakers be mounted to a first wall of the duct so that a diaphragm for the loudspeakers is in acoustic communication with the volume within the duct (i.e. the first volume in the chamber). It is preferred that a second pair of loudspeakers be mounted to a second wall of the duct so that a diaphragm of the loudspeakers is in acoustic communication with the volume within the duct (i.e. the first volume in the chamber). The second pair of loudspeakers faces the first pair of loudspeakers. Both pairs of loudspeakers are preferably parallel to a longitudinal axis of the oval chamber. A port from the duct allows acoustic energy from within the duct to communicate with noise in the exhaust pipe.

A mixing apparatus is provided to mix acoustic energy, passing through the port from the loudspeakers, with noise propagating through the exhaust pipe. The apparatus includes an inner tube that connects to the exhaust pipe. The inner tube has a plurality of circumferential openings along a portion of the robe. An outer wall of the mixing apparatus surrounds the plurality of the openings in the inner tube to create an annular volume around the plurality of openings. The outer wall has an opening to which a mounting duct is mounted. The mounting duct is mounted to the isolated chamber to cover the port from the duct within the chamber, thus providing a path for acoustic energy from the loudspeakers within the isolated chamber to communicate with noise propagating through the inner tube of the mixing apparatus.

Other objects and advantages of the present invention will be apparent from the following detailed description when considered in conjunction with the accompanied drawings.

BRIEF DESCRIPTION OF THE DRAWINGS

Parent Application

Present Invention

Figure 6:
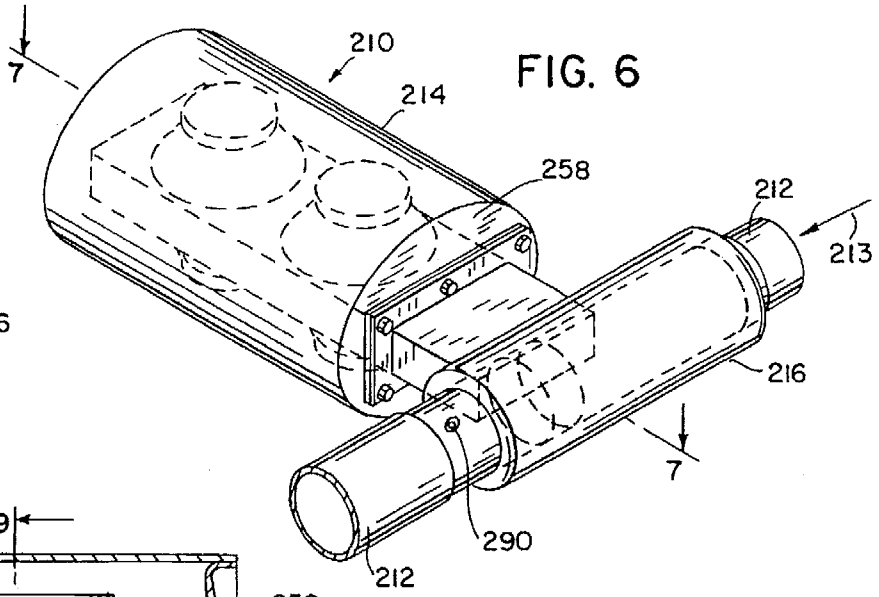

FIG. 6 is a perspective view of an active silencer in accordance with the present invention.

Figure 7:
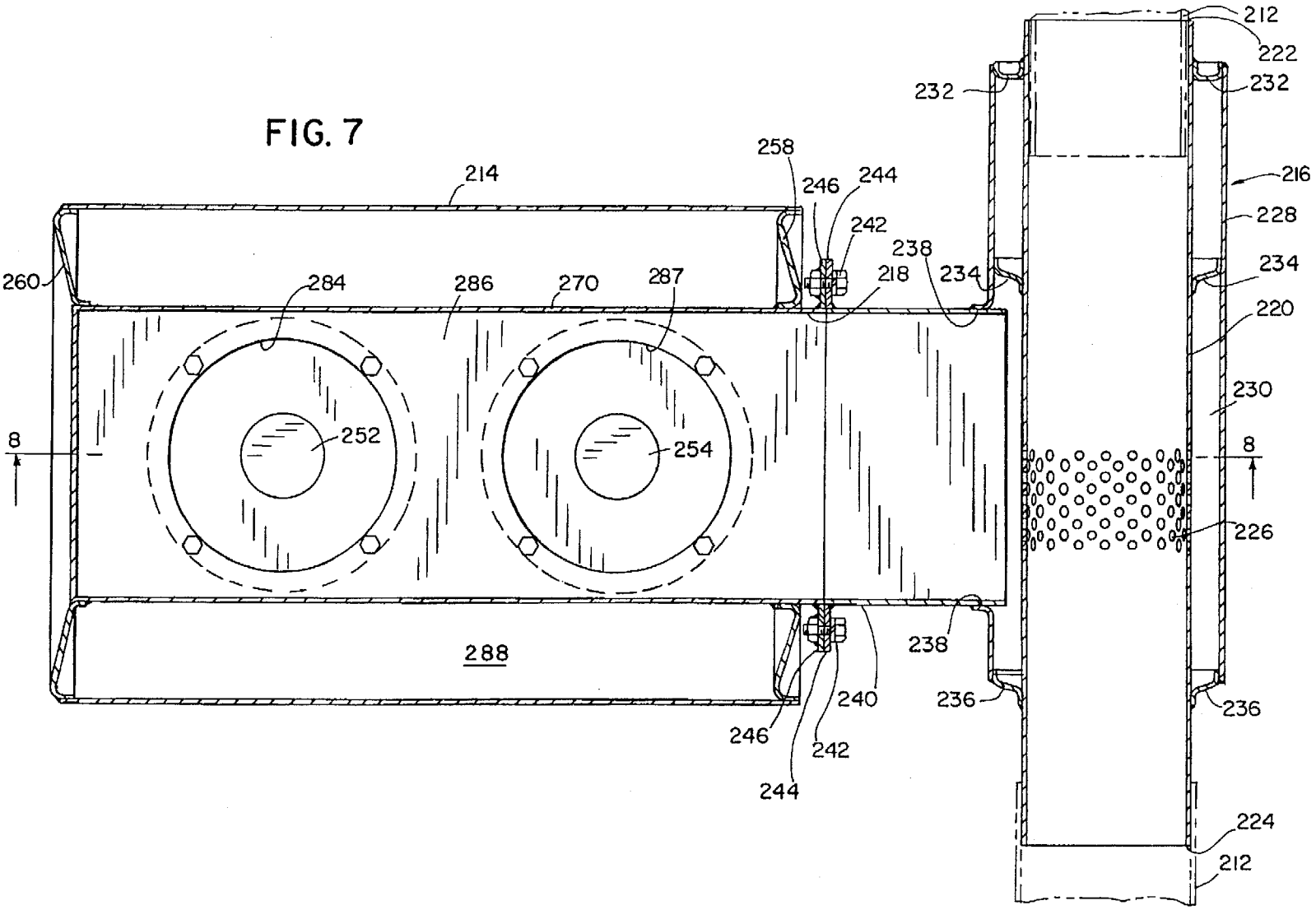

FIG. 7 is a cross-sectional view taken along line 7—7 in FIG. 6.

Figure 8:
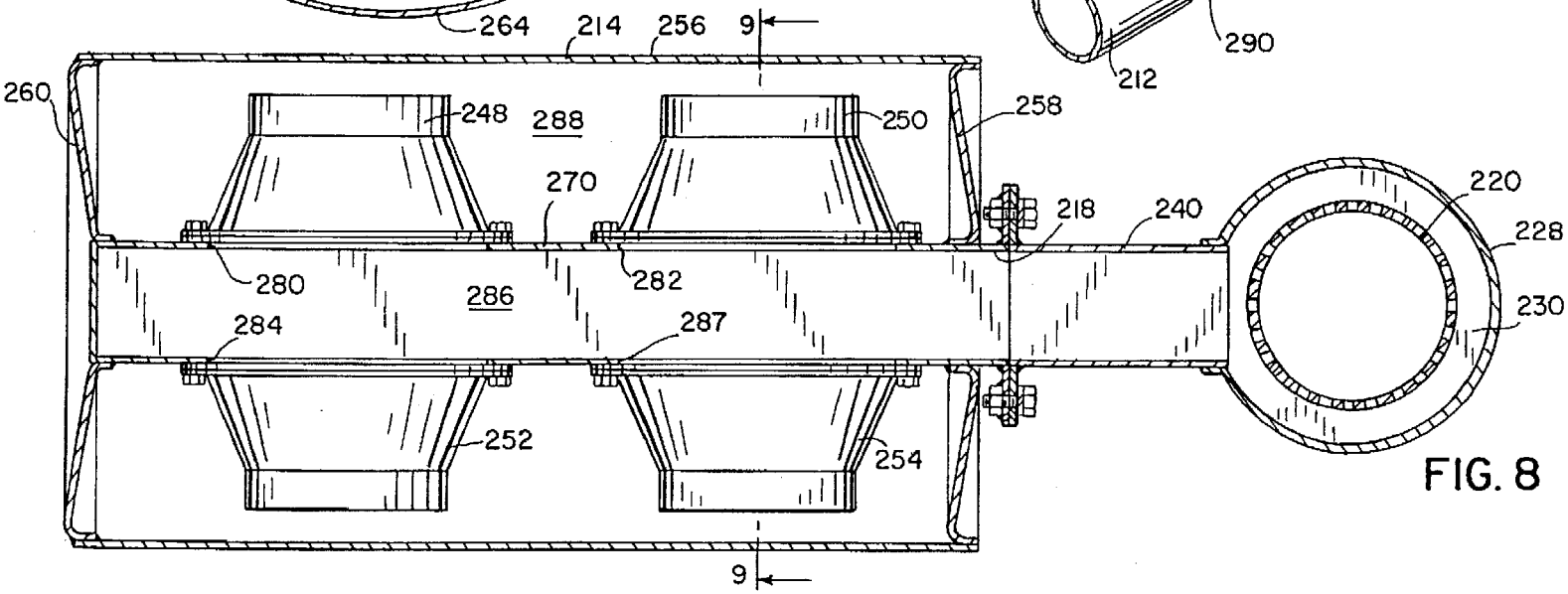

FIG. 8 is a sectional view taken along line 8—8 in FIG. 7.

Figure 9:
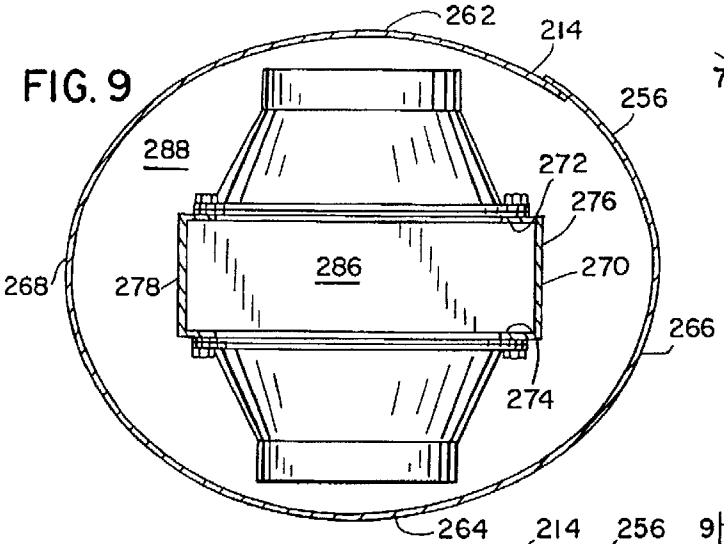

FIG. 9 is a sectional view taken along line 9—9 in FIG. 8

DETAILED DESCRIPTION OF THE DRAWINGS

Referring to FIGS. 1–4, an active silencer 10 attenuates sound propagating through exhaust pipe 12. Exhaust gas flows through exhaust pipe in the direction of arrow 13 and engine noise also propagates through exhaust pipe 12 in the direction of arrow 13. A canceling acoustic wave is generated in an isolated chamber 14 and communicates with a mixing chamber through a port 18. The canceling acoustic wave mixes with engine noise in the mixing chamber 16 to destructively interfere with the engine noise.

The mixing chamber 16 has an inlet end with an upstream wall 20. The upstream wall 20 has an exhaust pipe opening 22 and a port opening 24.

Since the port 18 is connected next to the exhaust pipe 12 on the upstream wall 20 of the mixing chamber 16, exhaust gas does not in general flow back through the port 18 into the isolated chamber 14. The exhaust pipe is attached to the upstream wall 20 around the exhaust pipe hole 22. The port 18 is connected to the upstream wall 20 around the port opening 24. The upstream wall 22 has a peripheral edge 26 in the shape of an oval. The mixing chamber 16 has a generally oval-shaped cylindrical wall 28 that is attached to the peripheral edge 26 of the upstream wall 20. It is preferred that the cross-section of the oval-shaped mixing chamber 16 be as small as masonable to accommodate openings 22 and 24 in the upstream wall 20 of the mixing chamber 16. It is also preferred that the mixing chamber 16 be long enough so that the canceling acoustic waves can completely mix with the engine noise before exiting through an outlet 30 of the mixing chamber 16.

An error microphone 32 is preferably located within the mixing chamber 16 approximately 3" from the outlet 30. However, the error microphone 32 can be located anywhere towards the outlet 30 of mixing chamber 16. The preferred system is thus an "in pipe" cancellation system which has the advantage of eliminating the effects of non-exhaust noises from the surrounding atmosphere. Alternatively, indirect error sensing can be used such as is disclosed in Eriksson, U.S. patent application Ser. No. 08/118,877, filed on Sep. 9, 1993, now U.S. Pat. No. 5,418,873 which is incorporated herein by reference. Such an indirect error sensing scheme would include an error microphone 34 (shown in phantom in FIG. 1) in the exhaust pipe 12. The indirect error sensing system may also include another error microphone 36 (shown in phantom in FIG. 1) in port 18. If such an indirect error sensing scheme is used, it may be possible to eliminate the mixing chamber 16 and convert the system to an "out of pipe" cancellation system where the canceling acoustic wave from the port 18 mixes with the noise from the exhaust pipe 12 in the atmosphere.

A front speaker 38 and a rear speaker 40 are located within the isolated chamber 14 and generate the canceling acoustic wave. Since exhaust does not flow back through the port 18 into the isolated chamber 14, the speakers 38 and 40 inside the chamber 14 are virtually free from direct exposure to exhaust gas. This means that no insulating scheme is needed to shield the speakers against heat or corrosive gases inside the enclosure. The speakers 38 and 40 both face downwards in the isolated chamber 14, and this helps prevent moisture from accumulating in the speakers.

The isolated chamber 14 is an enclosing wall structure with an outer wall 42, a front end wall 44 and a rear end wall 46. The outer wall 42 is an oval-shaped cylindrical wall having a front edge 48 and a rear edge 50. The outer wall 42 has a front electrical connector 49 and a rear electrical connector 51 through the upper portion of the wall 42. Power is provided to the speakers 38 and 40 from an electrical controller via the electrical connector 49 and 51.

Figure 1:
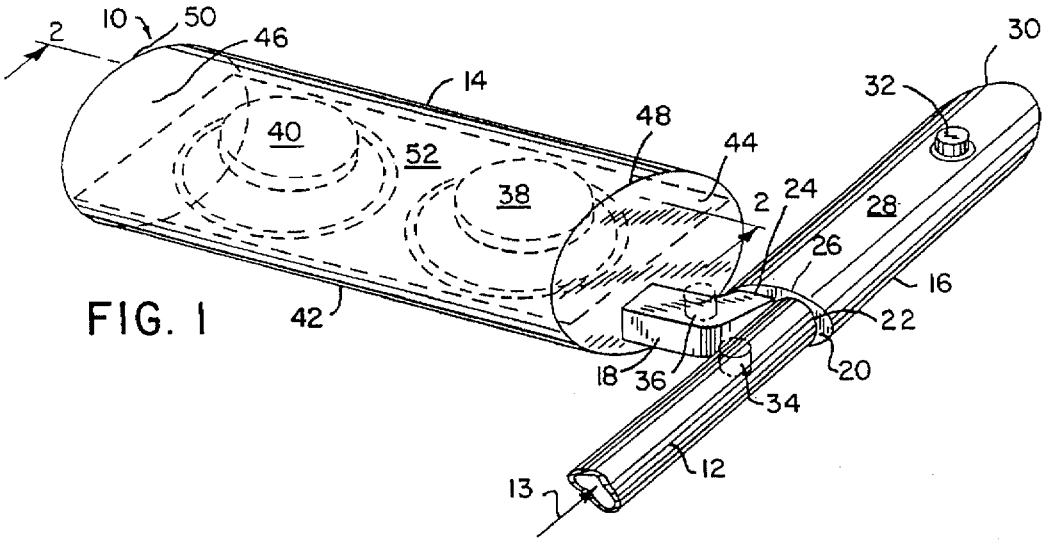
FIG. 1 is a perspective view of an active silencer in accordance with the invention as disclosed in the parent application.
Figure 2:
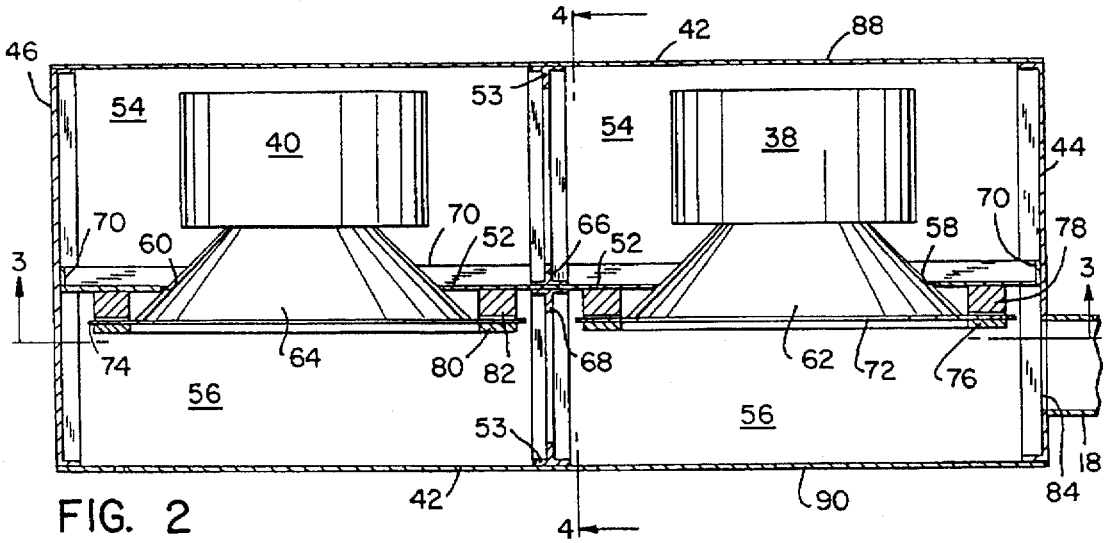
FIG. 2 is a longitudinal cross-sectional view taken along line 2—2 in FIG. 1.
Figure 4:
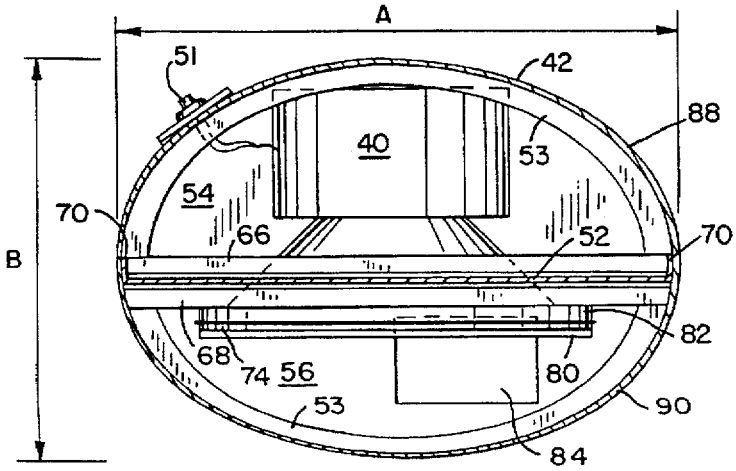
FIG. 4 is a cross-sectional view taken along line 4—4 in FIG. 2.
Figure 3:
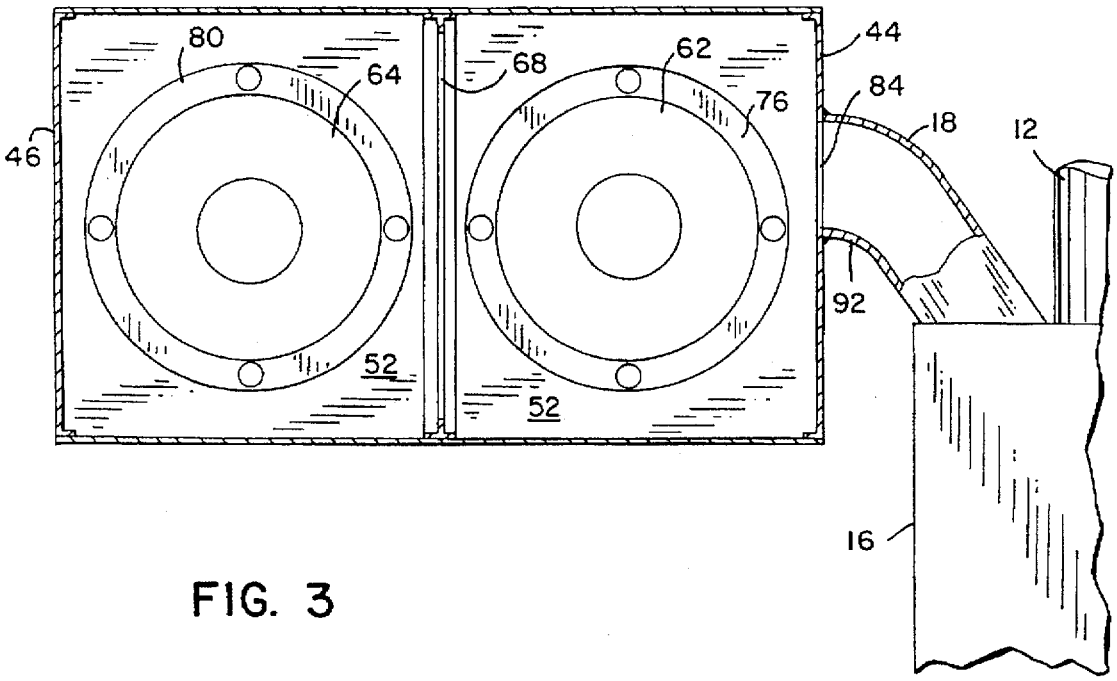
FIG. 3 is a top cross-sectional view taken along line 3—3 in FIG. 2.

The oval-shaped cylindrical outer wall 42 preferably has a height of 6.5" (represented as B in FIG. 4) and a width of 8" (represented as A in FIG. 4). The chamber 14 thus has a preferred aspect ratio of 6.5/8. Such a structure has a low-profile and can be used on many conventional automobiles without altering the automobile. The front 44 and rear 46 end walls are also oval-shaped with corresponding dimensions. The front end wall 44 is attached to the front edge 48 of the oval-shaped cylindrical outer wall 42. The rear end plate 46 is attached to the rear edge 50 of the oval-shaped outer cylindrical wall 42.

A reinforcement flange 53 is integral with the inside surface of the outer wall 42. The reinforcement flange 53 extends around the inside circumference of the outer wall 42, and is substantially equal distance between the front 44 and the rear 46 end walls.

A partition 52 separates the isolated chamber 14 into a top volume 54 and a bottom volume 56. The top volume 54 is preferably 2.26 liters. The bottom volume 56 is preferably 1.8 liters. The partition 52 is located in the lower part of the chamber 14. The partition 52 has a front speaker hole 58 and a rear speaker hole 60 therethrough. Front speaker 38 is mounted to the partition 52 through speaker hole 58. The rear speaker 40 is mounted to the partition 52 through hole 60. The front speaker 38 has a diaphragm 62 and the rear speaker 40 has a diaphragm 64. The diaphragms 62 and 64 are in acoustic communication with the bottom volume 56. When mounted to the partition 52, the speakers 38 and 40 reside mostly in the top volume 54, and are relatively close to the outer wall 42.

An upper flange 66 and a lower flange 68 reinforce the partition 52. The upper flange 66 is integral with the partition 52 and extends into the top volume 54. The upper partition flange 66 is located between the front 58 and the rear 60 speaker holes. The lower partition flange 68 is similar to the upper partition flange 66 except the lower partition flange 68 extends into the lower volume 56.

The partition 52 has a peripheral edge 70 which is bent upwards at a 90° angle so that the peripheral edge 70 has an upward facing flange of about ¼". The bend of the peripheral edge 70 facilitates attachment of the partition 52 to the outer wall 42 and the end walls 44 and 46, and also further reinforces the partition 52.

Each speaker 38 and 40 has a speaker basket 72 and 74, respectively, that supports the speaker diaphragm. Each speaker is mounted to the partition 52 by mounting the speaker basket to the partition 52. In particular, front speaker 38 is mounted to the partition 52 by attaching the basket 72 to the partition 52 with nuts and bolts. A securing ring 76 can be used between the nuts and the basket 72 to provide even support for the basket 72. Additionally, a front spacer 78 can be placed between the partition 52 and the basket 72. Likewise, rear speaker 40 can be mounted to partition 52 by screwing the basket 74 on the rear speaker 40 to the partition 52 with the user of a security ring 80 and a rear spacer 82. The use of the spacers 78 and 82 allows the speakers 38 and 40 to be mounted lower in the isolated chamber 14, thus further reducing the height of the chamber 14.

The front end wall 44 has a port hole 84 that opens into the bottom volume 56. The port 18 is attached to the front end wall 44 around the port hole 84 so that a canceling acoustic wave generated by the speakers 38 and 40 can propagate from the bottom volume 56 through the port 18 into the mixing chamber 16. The port is preferably sized in length and width so that the combination of the bottom volume 56 and the port 18 respond as a ported tuning chamber which distributes speaker power within the proper frequency band for normal operation.

Figure 5:
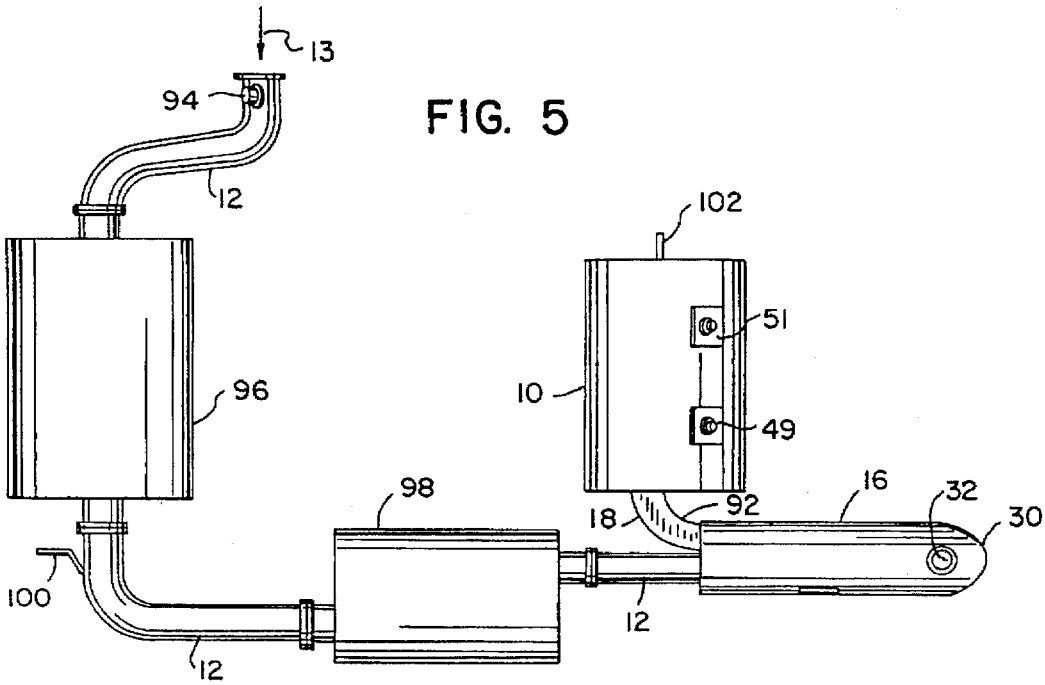
FIG. 5 is a schematic top view of an exhaust system employing the invention as disclosed in the parent application.

Referring to FIG. 5, the active silencer 10 can be used in conjunction with one or more passive silencers in an exhaust system. Exhaust gas flows from the engine in the direction of arrow 13 through exhaust pipe 12. An input microphone 94 can be located before passive silencers 96 and 98 along the exhaust pipe 12. The entire system shown in FIG. 5 can be hung underneath a vehicle with hangers 100 and 102 in much the same fashion as a conventional passive system is hung.

The microphones used are preferably high temperature microphones. An electronic controller controls the output of the speakers 38 and 40 in the active silencer 10 in response to the microphone signals. The electronic controller can be located in the tank of the car. It is preferred that the weights in the electronic controller for the adaptive analysis be preloaded to eliminate the need for initial modeling every time the engine is started. Also, it is preferred that the active system be wired to the ignition circuit of the automobile.

The preferred method of fabricating the active silencer 10 is now described. A flat sheet of 13.5" by 15.5" 16 gauge stainless steel is used to make an upper portion 88 of the oval-shaped cylindrical wall 42. Two 1" holes are drilled or cut out of the 13.5" by 15.5" sheet for electrical connectors 49 and 51, one hole for each speaker 38 and 40. The sheet is then rolled to form an upper portion of an oval-shaped cylinder 88. Note that the upper portion 88 of the oval-shaped cylinder is larger than a lower portion 90 of the oval-shaped cylinder 42. The reinforcement flanges 53 for the upper portion 88 and the lower portion 90 of the cylindrical wall 42 are preferably made from 16 gauge stainless steel and are either prefabricated or made by welding two strips of the steel together in a tee. A reinforcement flange 53 is welded to the upper portion 88 of the oval-shaped cylindrical wall 42 to reinforce the upper portion of the cylinder.

The bottom portion 90 of the oval-shaped cylindrical wall 42 is made from a 10.5"×15.5" sheet of 16 gauge stainless steel. A drain hole is drilled in the sheet, and the sheet is rolled to fit the oval-shaped end walls 44 and 46. The flange 53 is welded to the bottom portion 90 of the oval-shaped wall 42.

The front end wall 44 and the rear end wall 46 are preferably 16 gauge stainless steel, oval-shaped, and normally prefabricated. The front end wall 44 and the rear end wall 46 are welded to the upper portion 88 of the oval-shaped cylindrical wall 42. The port hole 84 is cut into the lower portion of the front end wall 44 before the front end wall 44 is welded to the upper portion 88 of the oval-shaped cylindrical wall 42.

The port 18 is fabricated preferably from 16 gauge stainless steel walls welded together. The port 18 preferably has a rectangular cross section with about a 1.57" height and a 1.97" width. The port 18 is bent along its axis between the isolated chamber 14 and the mixing chamber 16 at about a 45° angle. The bend 92 allows the isolated chamber 14 to be placed in a convenient location.

The partition 52 is preferably made from an 8.75" by 15" flat sheet of 16 gauge stainless steel. The speaker holes 58 and 60 and the bolt holes for mounting the speakers 38 and 40 are cut into the sheet. The peripheral edge 70 of the partition sheet is bent upward 90° ¼" from the edge 70 to add strength and provide weld area. Five ¼" weld holes are evenly spaced between the speaker holes 58 and 60 and are aligned parallel to the front 44 and end 46 walls. Bolts are welded to the partition 52 through the bolt holes so that the speakers 38 and 40 can be mounted after welding is completed. The upper partition flange 66 and the lower partition flange 68 are welded to the partition 52 through the evenly spaced plug holes, and are also welded along each side of the flange.

The speaker 38 and 40 are mounted to the partition 52 by attaching the speaker baskets 74 and 72 to the bolts using nuts, spacers and securing rings as described before. The speakers 38 and 40 are mounted side by side and face downwards. The partition 52 is welded to the front 44 and rear 46 end walls and the upper portion 88 of the outer oval-shaped cylindrical wall 42. The lower portion 90 of the oval-shaped cylindrical wall is welded to the front 44 and rear 46 end walls and the bottom edge of the upper portion 88 of the oval-shaped cylindrical wall 42.

It can be appreciated that the front 38 and rear 40 speakers share the common top 54 and bottom 56 volumes, and this simplifies the complexity of the active silencer 10, and allows efficient fabrication of an active silencer that has a low-profile and is structurally stable.

Present Invention

Referring to FIGS. 6–9, an active silencer 210 attenuates sound propagating through exhaust pipe 212. Exhaust gas flows through exhaust pipe 212 in the direction of arrow 213 and engine noise also propagates through the exhaust pipe 212 in the direction of arrow 213 (see FIG. 6). A cancelling acoustic wave is generated in an isolated chamber 214 and communicates with a mixing apparatus 216 through a port 218, FIGS. 7 and 8. The cancelling acoustic wave mixes with engine noise in the mixing apparatus 216 to destructively interfere with the engine noise.

The mixing apparatus 216 has an inner tube 220, FIG. 7. The inner tube 220 has an inlet 222 that receives the exhaust pipe 212 and an outlet 224. The diameter of the inner tube 220 corresponds generally to the diameter of the exhaust pipe 212. The inner tube 220 includes a plurality of openings 226 that pass through the wall of the inner tube 220, and extend circumferentially around the inner tube 220. The mixing apparatus 216 also includes an outer wall 228 that extends around the inner tube 220. The outer wall 228 encloses a volume 230 around the plurality of openings 226 in the inner tube 220. The outer wall 228 is preferably cylindrical and coaxial with the inner tube 220, and is mounted to the inner tube 220 by welding annular flanges 232, 234 and 236 between the inner tube 220 and the outer wall 228. The outer wall 228 includes a mounting duct opening 238. The mounting duct opening 238 opens into the annular volume between mounting flanges 234 and 236, and thus communicates acoustically with the plurality of openings 226 through the inner tube 220. The mixing apparatus 216 also includes a mounting duct 240 that is attached to the mixing apparatus 216 around the mixing duct opening 238. The mounting duct 240 for the mixing apparatus 216 is mounted to the isolated chamber 214 by securing bolts 242 through mounting flanges 244 and 246 so that acoustic energy passing through the port 218 oft he isolated chamber 214 communicates with noise propagating through the inner tube 220.

Four loudspeakers 248, 250, 252, and 254 are located within the isolated chamber 214 and generate the cancelling acoustic wave. It is unlikely that exhaust flowing through the exhaust tube 212 and the inner tube 220 of the mixing apparatus 216 will flow through mounting duct 240, and through port 218, into the isolated chamber 214. Thus, the speakers 248, 250, 252 and 254 are virtually free from direct exposure to exhaust gas. This means that no insulating scheme is necessary to shield the speakers against heat or corrosive gases inside the enclosure 214.

The isolated chamber 214 is an enclosing wall structure with an outer wall 256, a front end wall 258 and a rear end wall 260. The outer wall 256 has an oval cross-section in which the maximum distance between a first side 262 and a second side 264 of the oval outer wall 256 is less than the maximum horizontal width between a third side 266 and a fourth side 268 of the oval outer wall 256. The front end wall 258 is attached to the front edge of the oval shaped outer wall 256. The rear end wall 260 is attached to the rear edge of the oval outer wall 256. It is suitable that the maximum distance between the first side 262 and the second side 264 of the oval outer wall 256 be about 12 inches, and that the maximum distance between the third side 266 and the fourth side 268 of the oval outer wall 256 be slightly less than 15 inches. Such a structure can be mounted horizontally to provide a relatively low-profile, or can be mounted vertically or at an angle to facilitate packaging without altering the vehicle.

A longitudinal duct 270 extends from the rear wall 260 through the chamber 214 and through the front wall 258. It may be desirable that the duct 270 and the port 218 be sized to serve as a common tuning chamber for the loudspeakers 248, 250, 252, and 254. The duct 270 has a rectangular cross-section and is defined by a first wall 272, a second wall 274 parallel to the first wall 272, a third wall 276, and a fourth wall 278 parallel to the third wall 276. The distance between the first wall 272 and the second horizontal wall 274 of the duct 270 is preferably about 3 inches. The preferred distance between the third wall 276 and the fourth wall 278 of the duct 270 is preferably about 9 inches. The duct 270 separates the interior of the chamber 214 into a first 286 and second volume 288. The first wall 272 of the duct 270 includes a first speaker hole 280 and a second speaker hole 282. The first loudspeaker 248 is mounted to the duct 270 through the first speaker hole 280 so that a diaphragm of the first loudspeaker 248 is in acoustic communication with the first volume 286 within the duct 270. The second loudspeaker 250 is mounted to the duct 270 through the second speaker hole 282 so that a diaphragm of the second loudspeaker 250 is in acoustic communication with the first volume 286 within the duct 270. Both the first loudspeaker 248 and the second loudspeaker 250 are mounted in parallel to a longitudinal axis through the oval chamber 214.

The second wall 274 of the duct 270 includes a third speaker hole 284 and a fourth speaker hole 287. The third loudspeaker 252 is mounted to the duct through the third speaker hole 284 so that a diaphragm of the third loudspeaker 252 is in acoustic communication with the first volume 286 within the duct 270. Likewise, the fourth loudspeaker 254 is mounted to the duct 270 through the fourth loudspeaker hole 287 so that a diaphragm of the fourth loudspeaker 254 is in acoustic communication with the first volume 286 within the duct 270. Both the third and fourth loudspeakers 252 and 254 are mounted in parallel to a longitudinal axis through the oval chamber 214, and face the first and second loudspeakers 248 and 250.

It is readily apparent that the second volume 288 within the isolated chamber 214 and outside of the duct 270 is substantially larger than the first volume 286 within the duct 270. This is useful to reduce mechanical loads on the loudspeakers 248, 250, 252 and 254. It should be noted that it may be desirable that the system shown in FIGS. 6–9 include less than four speakers. For instance, it may be desirable to remove loudspeakers 252 and 254 from the system, thus allowing isolated chamber 214 to be constructed having a smaller distance between the first side 262 and the second side 264 of the outer oval wall 256. Also, it may be desirable to remove a pair of opposed loudspeakers such as loudspeakers 250 and 254, thus allowing the horizontal length of the isolated chamber 214 to be shortened.

Referring to FIG. 6, an error microphone 290 is preferably located through the inner tube 220 on the mixing apparatus 216 downstream of the plurality of openings 226 through the inner tube 220.

The active exhaust silencer 210 shown in FIGS. 6–9 should operate electrically in the same or similar manner as the silencer depicted in FIGS. 1–5. Electrical connectors such as electrical connectors 49 and 51 shown in FIGS. 4 and 5 are preferably provided through the outer wall 256 to provide power to the speakers 248, 250, 252, and 254.

The active exhaust silencer 210 shown in FIGS. 6–9 can be used in conjunction with a passive muffler either upstream or downstream of the active silencer 210.

It is recognized that various equivalents, alternatives and modifications are possible and should be considered within the scope of the claims.

We claim:

1. An active silencer for cancelling noise propagating through an exhaust pipe comprising:

a chamber having an enclosing wall structure with an outer wall, a front end wall and a rear end wall;

a duct separating the chamber into a first volume within the duct and a second volume outside of the duct, the duct having a speaker hole therein;

a loudspeaker mounted to the duct through the speaker hole so that a diaphragm of the speaker is in acoustic communication with the first volume within the duct; and a port extending through the front end wall of the chamber from the first volume within the duct, the port communicating acoustically with noise propagating through the exhaust pipe;

wherein the duct has a rectangular cross-section and the speaker hole is through a first wall of the duct, and the duct further includes a second speaker hole through the first wall of the duct; and the active silencer further comprises a second loudspeaker mounted to the duct through the second speaker hole so that a diaphragm of the second speaker is in acoustic communication with the first volume within the duct.

2. An active silencer as recited in claim 1 wherein the duct includes third and fourth speaker holes through a second wall of the duct; and the active silencer further comprises a third loudspeaker mounted to the duct through the third speaker hole so that a diaphragm of the third loudspeaker is in acoustic communication with the first volume within the duct, and a fourth loudspeaker mounted to the duct through the fourth speaker hole so that a diaphragm of the fourth loudspeaker is in acoustic communication with the first volume within the duct.

3. An active silencer for cancelling noise propagating through an exhaust pipe comprising:

a chamber having an enclosing wall structure with an outer wall, a front end wall and a rear end wall;

a duct separating the chamber into a first volume within the duct and a second volume outside of the duct, the duct having a speaker hole therein;

a loudspeaker mounted to the duct through the speaker hole so that a diaphragm of the speaker is in acoustic communication with the first volume within the duct; and a port extending through the front end wall of the chamber from the first volume within the duct, the port communicating acoustically with noise propagating through the exhaust pipe;

wherein the silencer further comprises a mixing apparatus including:

an inner tube having an inlet that receives the exhaust pipe and an outlet, the inner tube having a plurality of openings through a wall of the inner tube;

an outer wall of the mixing apparatus extending around the inner tube and enclosing the plurality of openings in the inner tube, the outer wall of the mixing apparatus having a mounting duct opening therethrough; and a mounting duct extending from the outer wall of the mixing apparatus around the mounting duct opening through the outer wall of the mixing apparatus, the mounting duct being mounted to the port extending through the front end wall of the chamber so that acoustic energy passing through the port communicates acoustically with noise in the inner tube of the mixing apparatus.

4. An active silencer for canceling noise from an exhaust pipe comprising:

a chamber isolated from an exhaust pipe, the chamber having an enclosing wall structure with an oval-shaped cylindrical outer wall, the interior of the chamber being separated into a first volume and a second volume;

a first loudspeaker mounted to the silencer within the chamber so that a diaphragm of the first loudspeaker is parallel to a longitudinal axis of the chamber and so that the diaphragm of the first loudspeaker is in acoustic communication with the first volume in the chamber;

a second loudspeaker mounted to the silencer within the chamber so that a diaphragm of the second loudspeaker is parallel to the longitudinal axis of the chamber and so that the diaphragm of the second loudspeaker is in acoustic communication with the first volume in the chamber;

a third loudspeaker mounted to the silencer within the chamber so that a diaphragm of the third loudspeaker is parallel to the longitudinal axis of the chamber and so that the diaphragm for the third loudspeaker is in acoustic communication with the first volume in the chamber;

a fourth loudspeaker mounted to the silencer within the chamber so that a diaphragm of the fourth loudspeaker is parallel to the longitudinal axis of the chamber and so that the diaphragm for the fourth loudspeaker is in acoustic communication with the first volume in the chamber; and a port extending through the enclosing wall structure from the first volume in the chamber, the port communicating acoustically with the noise from the exhaust pipe.

* * * * *